United States Patent [19]

Sasaki

[11] 4,299,590

[45] Nov. 10, 1981

[54] CARTONING MACHINE

[75] Inventor: Mikio Sasaki, Nanatsuka, Japan

[73] Assignee: Shibuya Kogyo Company, Ltd., Kanazawa, Japan

[21] Appl. No.: 97,628

[22] Filed: Nov. 27, 1979

[30] Foreign Application Priority Data

May 25, 1979 [JP] Japan ..... 54-64694

[51] Int. Cl.[3] ..... B31B 3/02

[52] U.S. Cl. ..... 493/164; 493/169

[58] Field of Search ..... 93/51.1, 44.1 R, 44, 93/51 M, 51 R; 493/164, 169, 172

[56] References Cited

U.S. PATENT DOCUMENTS

| | | | |
|---|---|---|---|
| 1,864,632 | 6/1932 | Bergstein | 93/44.1 R |
| 1,888,808 | 11/1932 | Schmiedel | 93/51.1 X |
| 2,841,058 | 7/1958 | Bickford | 93/44 |
| 3,373,663 | 3/1968 | Heim | 93/44.1 R |

FOREIGN PATENT DOCUMENTS

| | | | |
|---|---|---|---|
| 378628 | 8/1932 | United Kingdom | 93/51.1 |

*Primary Examiner*—James F. Coan

*Attorney, Agent, or Firm*—Blanchard, Flynn, Thiel, Boutell & Tanis

[57] ABSTRACT

A cartoning machine which folds a carton blank into a carton having a box body and a box lid which are connected together during a single rotation of an intermittently rotating rotary body. The rotary body is provided with a plurality of pairs of positive dies, each pair of positive dies having dies respectively corresponding to the box body portion and the box lid portion. Disposed at certain angular intervals around the rotary body are a magazine for supplying carton blanks, a box body folding device having a box body negative die, a box lid folding device having a box lid negative die, and an ejecting section for discharging completed cartons. Cartons are continuously formed by the intermittent rotation of the rotary body and the relative movement between the above two box folding devices and the pairs of positive dies, the dies in each pair being movable back and forth separately.

8 Claims, 8 Drawing Figures

CARTONING MACHINE

BACKGROUND OF THE INVENTION (1) Field of the Invention

This invention relates to a cartoning machine for folding carton blanks into cartons. More particularly, the invention relates to a cartoning machine which folds a carton blank sheet into a carton having a box body and a box lid which are connected together.

(2) Description of the Prior Art

There have been proposed several kinds of cartoning machines and they have been practically employed in industry. However, they form simple box bodies that have no lids or have only connected flat lids. Accordingly, when box bodies and box lids are formed, it is necessary to make them separately by using separate box folding machines. Further, in the box folding machines in the prior art, it has been impossible to form cartons which have both box bodies and box lids that are connected together. While the formation of cartons having a box body and a box lid from a single carton blank sheet has been tried, when the box body and the box lid are simultaneously folded, the structure of box folding devices has become very complicated because the centers of the box body and the box lid move near to each other during the folding of the carton blank. Therefore, the machines are difficult to put to practical use.

BRIEF SUMMARY OF THE INVENTION

It is, therefore, the primary object of the present invention to provide a novel cartoning machine which forms a carton having a box body and a connected box lid.

Another object of the present invention is to provide a cartoning machine in which the operations from the taking-up of a carton blank to the delivery of a formed carton can be carried out during a single rotation of an intermittently rotating rotary body.

A further object of the present invention is to provide a cartoning machine which is simplified in structure by providing a box body forming step and a box lid forming step which are effected separately. Thus, in the cartoning machine of the present invention, the box body folding device and the box lid folding device are separately disposed around the rotary body of the machine.

Still a further object of the present invention is to provide a cartoning machine in which the approaching of the centers of the box body and box lid that is caused by the folding of both the box parts gives no ill effect to the box folding operation. For this purpose, the rotary body is provided with pairs of positive dies, each of which pairs includes positive dies which respectively correspond to the box body portion and the box lid portion of a carton blank. The positive dies are separately moved back and forth and the carton blank is drawn and supported thereon by sucker sections that are defined in the positive dies.

A further object of the present invention is to provide a cartoning machine in which, in the case that pasting is required, the pasting work is carried out when the carton blank is taken out from a supply magazine.

In accordance with the present invention, the cartoning machine comprises: a rotary body which is rotated intermittently; a plurality of pairs of positive dies which are supported by the rotary body and moved back and forth in directions to the outside of the rotary body, each pair of the positive dies having dies respectively corresponding to the box body portion and the box lid portion of the carton blank; sucker sections which are defined in the positive dies and serviceable for drawing and supporting the carton blanks thereon; working sections of including a supply section, box body folding section, box lid folding section and ejecting section which are disposed around the rotary body in accordance with the intermittent rotation angles of the rotary body; and box folding devices which are disposed in the above box body folding section and the box lid folding section and can be moved toward and away from respective ones of the above positive dies. The above cartoning machine is characterized in that each operation in each working section is carried out between movements of the rotary body with the controlling of back and forth movement of the positive dies and the controlling of suction of the sucker sections in the positive dies and in that the above controlling is synchronously interlocked with the rotation and stopping of the rotary body.

BRIEF DESCRIPTION OF THE DRAWINGS

These and other objects, features and advantages of the present invention will be more clearly understood by the following description of the preferred embodiment with reference to the accompanying drawings, in which.

DESCRIPTION OF PREFERRED EMBODIMENT

Referring now to the accompanying drawings, a preferred embodiment of the cartoning machine according to the present invention will be described in more detail.

Figure 1:
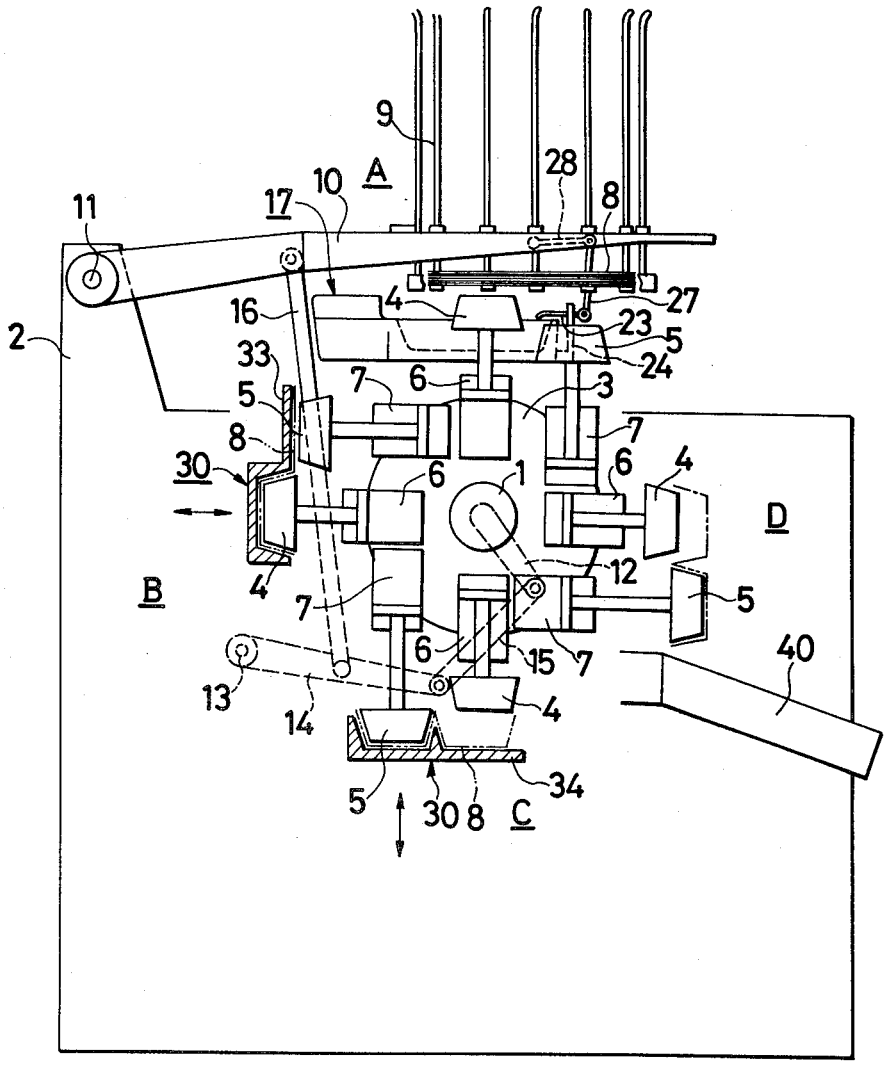
FIG. 1 is a front elevation of the embodiment of a cartoning machine of the present invention.
Figure 2:
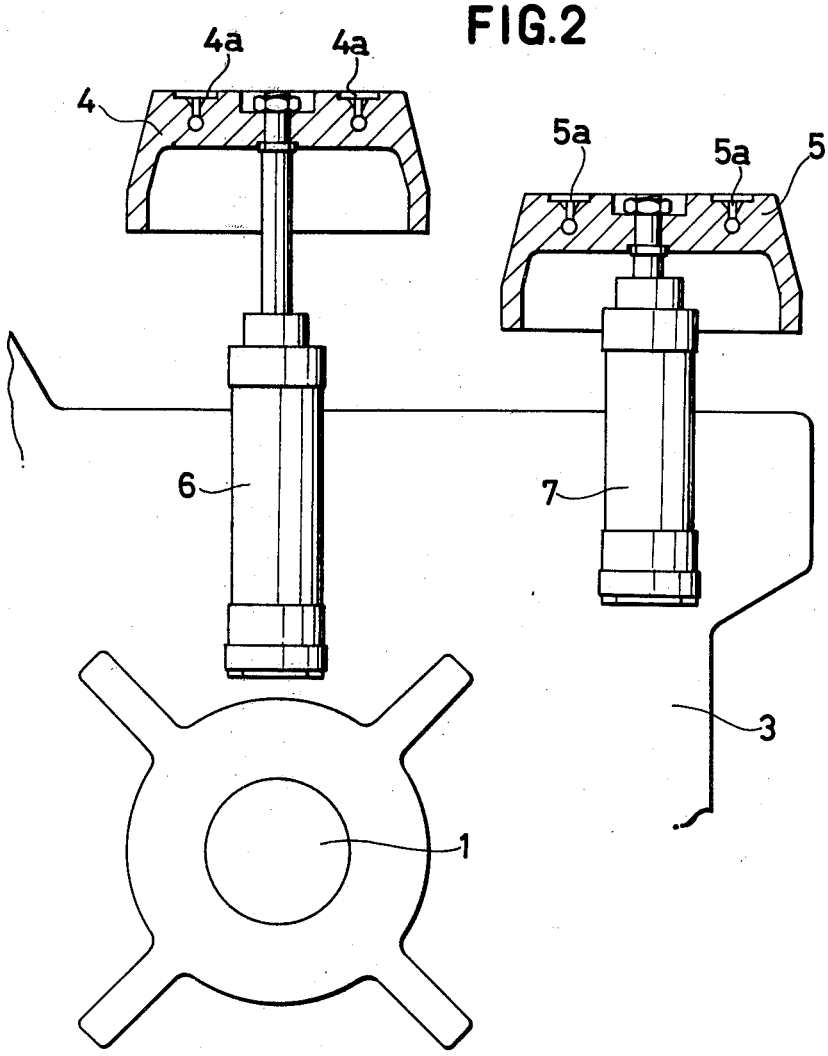
FIG. 2 is an enlarged front view, partly in section, of the positive dies and driving cylinder devices which are disposed on the rotary body.

In FIG. 1, a main shaft 1 is pivotally supported by a pair of side walls 2 (only the wall on one side is shown in FIG. 1). The main shaft 1 supports a rotary body 3 which is driven by an intermittently driving mechanism that is not shown in the drawing. In this embodiment, the rotary body 3 is turned intermittently through an arc of 90 degrees. Supported in each rotational angular position of the rotary body 3 are a pair of positive dies 4 and 5 in the shape of a truncated pyramid and a pair of cylinder devices 6 and 7 which move the dies 4 and 5 back and forth, respectively. As shown in FIG. 2, suction ports 4*a* and 5*a* are defined in the external surfaces of the positive dies 4 and 5, thereby forming sucker sections.

Figure 3:
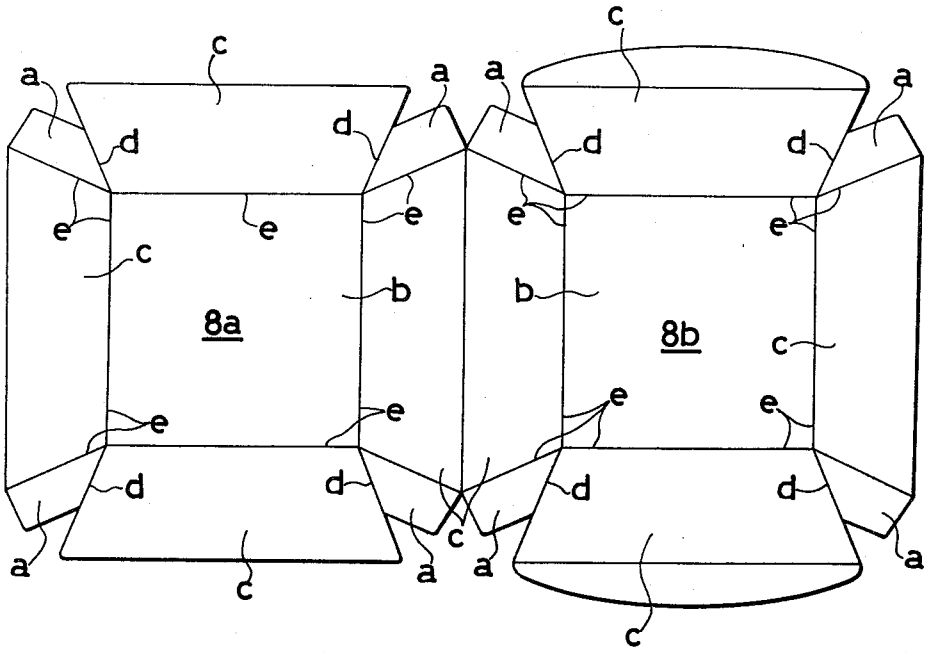
FIG. 3 is a plan view of an exemplary carton blank which is folded into a carton by using the cartoning machine of the present invention.

At positions corresponding to the rotational positions of the rotary body 3 and in the space around the rotary body 3, there are disposed a supply and pasting section A for carton blanks in the upper part, a box body folding section B on the left side as viewed in the drawing, a box lid folding section C on the under side and an ejecting section D on the right side for discharging folded boxes. As shown in FIG. 3, the carton blank 8 is composed of a box body portion 8*a* and a box lid portion 8*b* which are connected together. The supply and pasting section A takes up the carton blanks 8 one by one and spreads the flaps a of the carton blank 8 with paste. Each of the above-mentioned box body portions 8*a* and box lid portions 8*b* is composed of th flaps a, a bottom face b and side faces c, and the reference letter d denotes cut lines and reference letter e denotes score lines. The supply and pasting section A is provided with a magazine 9 so that the carton blanks 8 are supplied from the upper side and taken up from the lower side. The size of the magazine 9 is made adjustable so as to receive therein several differently-sized carton blanks. A supporting frame 10 which supports the magazine 9 is pivotally secured to the upper rear end of the side wall 2 by means of a shaft 11. This supporting frame 10 is actuated as follows.

A crank arm 12 which constitutes the driving section is supported by the main shaft 1 and the crank arm 12 is interlocked with the intermittent driving mechanism for the rotary body 3 and is intermittently turned once about the center of the main shaft 1 in each rotational angular position in which the rotary body 3 halts. A rocking rod 14 is pivotally secured to the side wall 2 by means of a pin 13 and it is connected to the crank arm 12 by way of a link 15. Further, the rocking rod 14 is connected to the supporting frame 10 by means of a vertical link 16. Accordingly, when a positive die 4 in a pair of dies 4 and 5 is shifted to the position under the magazine 9 by the rotation of the rotary body 3 and it is stopped, the crank arm 12 is turned once during the stop. By this rotation of the crank arm 12, the rocking rod 14 together with the supporting frame 10 is moved up and down so that the magazine 9 is also moved up and down almost vertically. Therefore, a carton blank 8 can be supplied to the positive die 4. By the way, the distance between the pair of positive dies 4 and 5 is set smaller than the distance between the box body portion 8*a* and box lid portion 8*b* of the carton blank 8.

Figure 4:
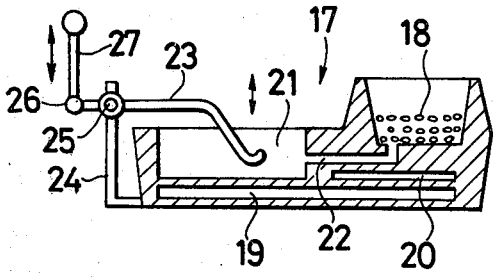
FIG. 4 is a partially cross-sectional front view of the pasting device, in which only the structures related to the pasting are shown.

The pasting device 17 constitutes the supply and pasting section A together with the magazine 9, and has the structure as shown in FIG. 4. The pasting devices 17 are disposed on both sides of and under the magazine 9 in face to face relation and leaving a space which allows the positive dies 4 and 5 to pass between them. In the drawing, only one of the pasting devices 17 is shown. The pasting device 17 is composed of a heating vessel 18 that is disposed on one side of the device 17 and receives a hot melt adhesive (a fast-drying nonvolatile adhesive) therein, a heating device 19 which is contained in the bottom part of the device 17 and used for heating up the hot melt adhesive in the heating vessel 18 under the regulation of a temperature controller 20, a paste well 21 which receives and holds the molten adhesive that is heated into a liquid state in the heating vessel 18 and fed through a passage 22 from the bottom of the heating vessel 18, and a pasting finger 23 the bent tip end of which is immersed into the paste well 21. The middle portion of this pasting finger 23 is pivotally supported by a pin 25 which is secured to a bracket 24 and the root end 26 of the pasting finger 23 is connected by the supporting frame 10 for the magazine 9 by means of links 27 and 28. Accordingly, the tip end of the pasting finger 23 is immersed into the paste well 21 when the magazine 9 is raised, while the application of paste to the predetermined parts of the carton blank 8 is done when the magazine 9 is moved down by the resulting upward movement of the tip end of pasting finger 23. Incidentally, it should be noted that the number of pasting fingers 23 corresponds to the number of flaps a of the carton blank 8 even though only one pasting finger 23 is shown in the drawing.

Figure 6:
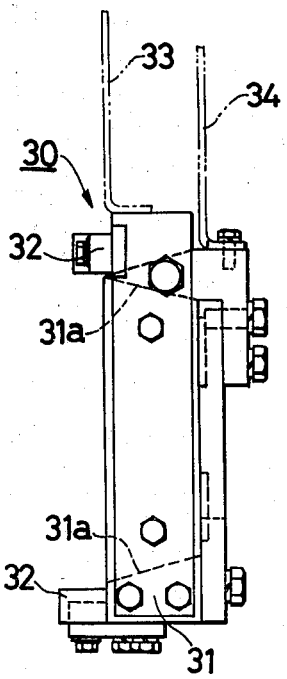
FIG. 6 is a side view of the same box folding device.
Figure 5:
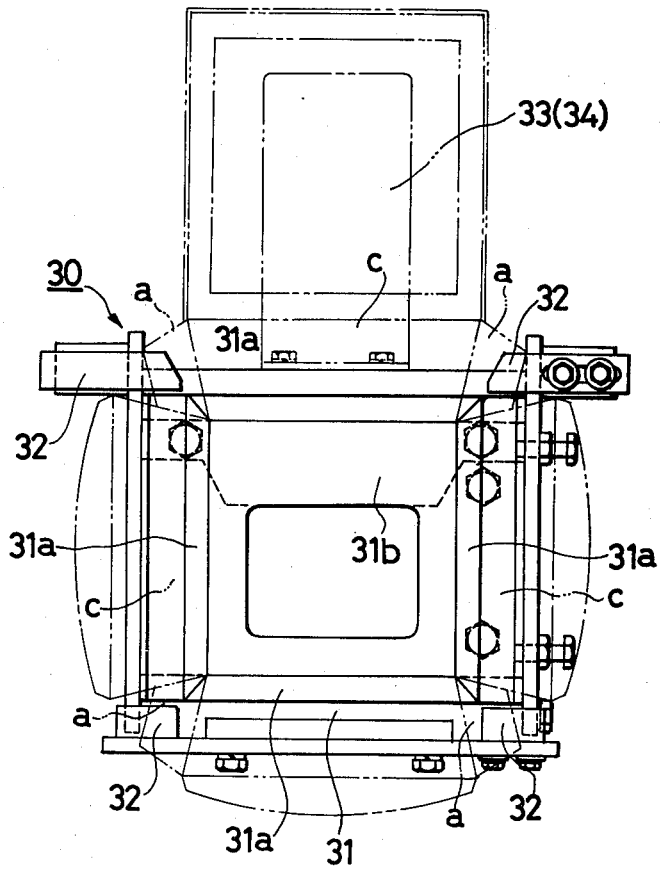
FIG. 5 is a plan view of a box folding device.

The box body folding section B and the box lid folding section C have box folding devices 30 which are substantially the same in their structures. As shown in FIGS. 5 and 6, the box folding device 30 is provided with a negative die 31, the shape of which corresponds to the shape of the positive dies 4 and 5 (a truncated pyramid in the embodiment shown in the drawings), and flap folding projections 32 which are attached to the front sides of the four corners of the negative die 31. These flap folding projections 32 correspond to the flaps a of the carton blank 8 and the inclined walls 31*a* of the negative die 31 correspond to the side faces c, and the bottom wall 31*b* to the bottom face b. Further, the box folding device 30 of the box body folding section B is provided with a carton supporting plate 33 which extends on the same plane as the front end face of the negative die 31. The box folding device 30 of the box lid folding section C is provided with a box body supporting plate 34 which extends on the same plane as the bottom wall 31*b* of the negative die 31.

These box folding devices 30 can be moved back and forth relative to the positive dies 4 and 5. This back and forth movement may be synchronously interlocked to the rotation of the foregoing crank arm 12, or it may be effected by independent cylinder devices. Furthermore, since it is only necessary that the box folding devices 30 can be moved to and from the positive dies 4 and 5, the box folding devices 30 can be made stationary when the strokes of cylinder devices 6 and 7 of the positive dies 4 and 5 are sufficiently elongated.

Figure 7:
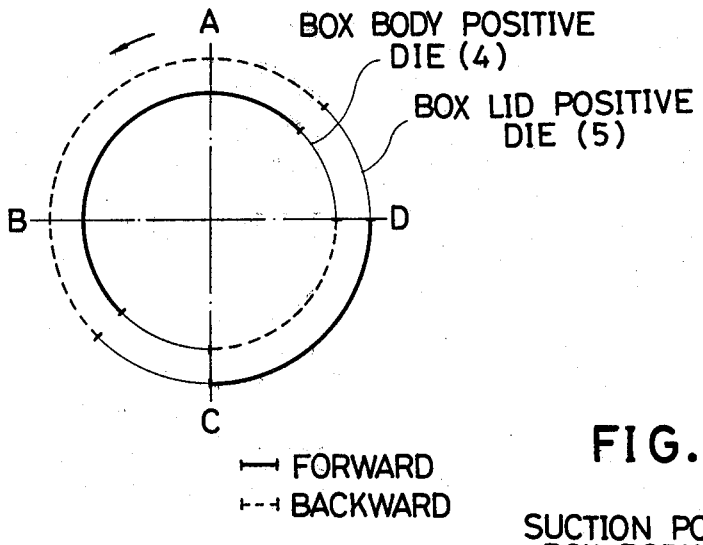
FIG. 7 is an explanatory drawing for showing the movement controlling of positive dies by cylinder devices.
Figure 8:
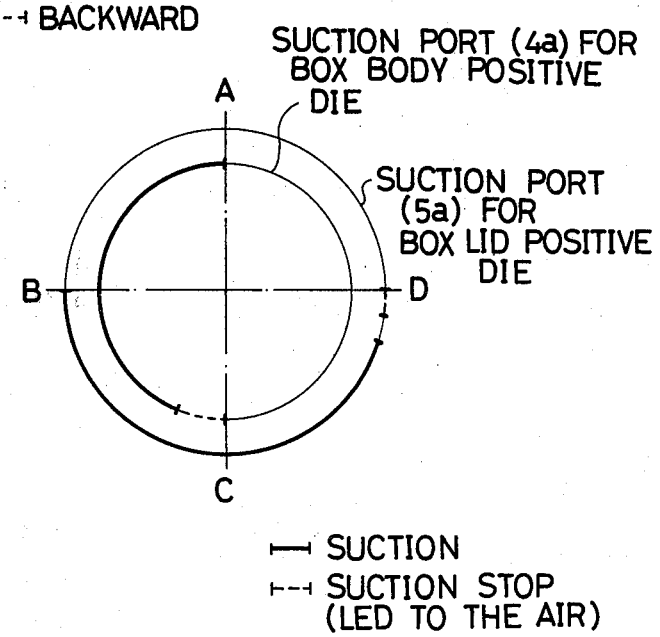
FIG. 8 is also an explanatory drawing for showing the air suction controlling of the suction ports of positive dies.

The controlling of compressed air for the cylinder devices 6 and 7 on the rotary body 3 and the controlling of suction for the suction ports 4*a* and 5*a* of the positive dies 4 and 5 can be attained by, for example, rotary valves. Thus, as shown in FIGS. 7 and 8, the controlling operations are carried out in a synchronous and interlocked relation with the rotation and the stopping of the rotary body 3. FIG. 7 shows the controlling of the cylinder devices 7 and 8, that is, the controlling of the back and forth movement of the positive dies 4 and 5 in accordance with the rotation angles of the rotary body 3. The inside circle indicates the positive die 4 for the box body and the outside circle indicates the positive die 5 for the box lid. The dies 4 and 5 take the forward (extended) positions in the solid line ranges and backward (retracted) positions in the dashed line ranges. FIG. 8 shows the controlling of the air suction for the suction ports 4*a* and 5*a*, where the inside circle indicates the suction ports 4*a* of the box body positive die 4 and the outside circle indicates the suction ports 5*a* of the box lid positive die 5. In the solid line ranges, the suction is actuated and it is stopped (by the introduction of air) in the ranges of dashed lines.

When the cartoning machine having the above-described structure is driven intermittently and the rotary body 3 is stopped at the position shown in FIG. 1, the crank arm 12 is turned once so that the magazine 9 of the supply and pasting section A is moved down. In this step, the positive die 4 is in the forward position and the air is withdrawn from the suction ports 4*a*, while the positive die 5 is in the rearward position. Therefore, the carton blank 8 carried in the magazine 9 is drawn against the positive die 4 at its box body portion 8*a*. At the same time, the tip ends of pasting fingers 23 are moved up in interlocked relation with the downward movement of the supporting frame 10, thereby pasting the flaps a of the carton blank 8.

In the box body folding section B, the box folding device 30 is moved toward the positive die 4 which carries the carton blank 8 thereon. Thus, in the first place, the folding projections 32 fold the flaps a of the box body portion 8*a* in the direction to the inside along the scores e. When the box folding device 30 is moved to the positive die 4, the side faces c of box body portion 8*a* of the carton blank 8 that is held between the positive die 4 and the negative die 31, are folded along the inclined walls 31*b* and these side faces c are pressed on the above-mentioned pasted flaps a. During this formation of the box body, the box lid portion 8*b* of the carton blank 8 is supported on the carton supporting plate 33 of the box folding device 30 and is thereby saved from deformation.

In the box lid folding section C, the formation of the box lid is performed by the box lid positive die 5 and the box folding device 30. That is, when the rotary body 3 is rotated to the box lid folding section C, the suction for the carton blank 8 by the box body positive die 4 is ceased as shown in FIGS. 7 and 8. Meanwhile, the box lid portion 8*b* is sucked against and supported on the die 5 by the actuation of the suction port 5*a* of the box lid positive die 5. At the same time, the positive die 4 is retracted and the positive die 5 is moved forward. When the box folding device 30 is moved forth toward the positive die 5 in such state, the formation of the box lid is carried out in the same manner as the formation of the box body. In this step, the box body is prevented from deforming because it is supported by the box body supporting plate 34. Further, the box folding device 30 is of course retracted to the original rearward position after the above-described box folding operation.

In the ejecting section D for discharging the formed boxes, the suction by the suction ports 4*a* and 5*a* of both the positive dies 4 and 5 is not effected, so that the suction ports 5*a* that drew the formed box body against the die 5 until this step are connected to a conduit leading to the ambient air. Accordingly, the formed box is delivered as it drops by its own weight through a chute 40. It goes without saying that the ejecting section D may be provided with a positively acting ejecting device which holds the formed box and discharges it or the air may be blown out from the suction ports 5*a* of the positive die 5.

While the present invention has been described with reference to a particular embodiment thereof, it should be understood that other changes and modifications will readily occur to those skilled in the art and hence the invention is not limited to the specific embodiment described herein, but is solely defined by the appended claims.

What is claimed is:

1. A cartoning machine for forming a carton having a box body and a box lid which are connected together, from a carton blank having a box body portion and a box lid portion which are connected together, said cartoning machine comprising:

a rotatably supported body which is indexible to a plurality of predetermined, angularly spaced positions;

a plurality of pairs of positive dies which are supported on said body at angularly spaced locations, each said positive die being reciprocably movable in a direction extending outwardly from said body, one positive die of each of said pairs corresponding to the box body portion of the carton blank and the other positive die of each of said pairs corresponding to the box lid portion of the carton blank;

selectively actuable suction means in each said positive die for drawing the corresponding portion of the carton blank against said positive die and supporting the carton blank thereon;

a plurality of spaced working stations adjacent said body, including a carton blank supply station, a box body folding station, a box lid folding station and an ejecting station, said working stations being disposed around said body at said angularly spaced positions so that said pairs of positive dies are successively positioned at said stations when said body is indexed; and first and second box folding devices which are respectively disposed at said box body folding station and said box lid folding station, said first and second box folding devices being relatively movable toward and away from a pair of said positive dies located at said box body folding station and said box lid folding station, respectively, for folding carton blanks into cartons when said devices approach said positive dies; and means for controlling operation of said suction means and said reciprocal movement of said pairs of positive dies so that the operations performed at each of said stations take place while said body is stationary.

2. The cartoning machine as claimed in claim 1, including a magazine for supplying carton blanks located at said carton blank supply station, whereby when said magazine is aligned with a pair of said positive dies on said body, a carton blank is drawn from said magazine and supported on at least one said positive die by said suction means thereon.

3. The cartoning machine as claimed in claim 2, including a pasting device located at said carton blank supply station for applying adhesive to one or more portions of each carton blank simultaneously with the drawing of the carton blank from said magazine.

4. The cartoning machine as claimed in claim 1, wherein the distance between said positive dies of each said pair of positive dies is smaller than the distance between the box body portion and the box lid portion of the carton blank.

5. The cartoning machine as claimed in claim 1, including valve means for actuating only said suction means on one positive die of each pair when such pair of positive dies is aligned with said box body folding station and for actuating only said suction means on said other positive die when such pair of positive dies is aligned with said box lid folding station.

6. The cartoning machine as claimed in claim 1, claim 2, claim 3, claim 4 or claim 5, wherein the carton blank has flaps on the box body and box lid portions thereof and wherein said first and second box folding devices are each provided with flap folding projections which contact the flaps of the associated portion of the carton blank as said box folding device and its associated positive die move toward each other and fold the flaps of the carton blank portion prior to the folding of the remainder of said portion of the carton blank.

7. The cartoning machine as claimed in claim 1, claim 2, claim 3, claim 4 or claim 5, wherein said first box folding device is provided with a first supporting plate for supporting the box lid portion of the carton blank during the folding of the box body portion, and wherein said second box folding device is provided with a second supporting plate for supporting the box body portion during the folding of the box lid portion.

8. The cartoning machine as claimed in claim 1, claim 2, claim 3, claim 4 or claim 5, wherein said first and second box folding devices each include a negative die, and the surfaces of said positive dies and said negative dies each define a truncated pyramid so that the box body and box lid are shaped in the form of a truncated pyramid.

* * * * *